US005945950A

United States Patent [19]

Elbadawy

[11] Patent Number: 5,945,950

[45] Date of Patent: Aug. 31, 1999

[54] STACKED MICROSTRIP ANTENNA FOR WIRELESS COMMUNICATION

[75] Inventor: Elsharawy A. Elbadawy, Gilbert, Ariz.

[73] Assignee: Arizona Board of Regents, Tempe, Ariz.

[21] Appl. No.: 08/733,756

[22] Filed: Oct. 18, 1996

[51] Int. Cl.[6] ..... H01Q 1/38

[52] U.S. Cl. ..... 343/700 MS; 343/770; 343/846

[58] Field of Search ..... 343/700 MS, 846, 343/770; H01Q 1/38

[56] References Cited

U.S. PATENT DOCUMENTS

| | | | |
|---|---|---|---|
| 4,131,892 | 12/1978 | Munson et al. . | |
| 4,367,474 | 1/1983 | Schaubert et al. | 343/700 MS |
| 4,700,194 | 10/1987 | Ogawa et al. | 343/700 MS |
| 4,701,763 | 10/1987 | Yamamoto et al. | 343/700 MS |
| 4,783,661 | 11/1988 | Smith . | |
| 4,791,423 | 12/1988 | Yokoyama et al. | 343/700 MS |
| 4,827,271 | 5/1989 | Berneking et al. | 343/700 MS |
| 4,835,541 | 5/1989 | Johnson et al. | 343/713 |
| 4,980,694 | 12/1990 | Hines | 343/702 |
| 5,041,838 | 8/1991 | Liimatainen et al. | 343/700 MS |
| 5,124,733 | 6/1992 | Haneishi | 343/700 MS |
| 5,173,711 | 12/1992 | Takeuchi et al. | 343/700 MS |
| 5,420,596 | 5/1995 | Burrell et al. | 343/700 MS |
| 5,450,090 | 9/1995 | Gels et al. | 343/700 MS |
| 5,455,596 | 10/1995 | Higashiguchi et al. | 343/741 |
| 5,703,601 | 12/1997 | Nalbandian et al. | 343/700 MS |

FOREIGN PATENT DOCUMENTS 0777295 6/1997 European Pat. Off. .

2552938 4/1985 France .

OTHER PUBLICATIONS

D. Schaubert et al, "Microstrip Antennas with Frequency Agility and Polarization Diversity"; *IEEE Transactions on Antennas and Propogation*, vol. AP–29, No. 1, Jan. 1981, pp. 118–123.

Patent Abstracts of Japan, 61041205, Feb. 1986.

Mohamed Sanad, "Effect of the Shorting Posts on Short Circuit Microstrip Antennas", IEEE Antennas and Propagation Symposium, 1994.

Keith Carver et al., "Microstrip Antenna Technology", IEEE Transactions on Antennas and Propagation, vol. AP–29, No. 1, Jan. 1981.

E. Penard and J.P. Daniel, "Open and Hybrid Microstrip Antennas", IEE Proceedings, vol. 131, Part H, No. 1, Feb. 1984.

*Primary Examiner*—Michael C. Wimer
*Attorney, Agent, or Firm*—Baker & Botts, L.L.P.

[57] ABSTRACT

A stacked short-circuited microstrip antenna including a ground plate attached to a bottom layer, where each layer of the antenna is a dielectric layer with a radiating plate affixed to its top and one side of each dielectric layer is short-circuited. The short-circuited side of each dielectric layer is positioned 90 degrees apart from the short-circuit directly below it in the stacked layers. The antenna configuration allows for a physically small microstrip antenna with a sufficiently large resonant band width for use with a cellular phone or other communication device and also benefits from circular polarization which reduces signal loss in bad weather or another sources of interference.

10 Claims, 6 Drawing Sheets

STACKED MICROSTRIP ANTENNA FOR WIRELESS COMMUNICATION

FIELD OF THE INVENTION

This invention relates generally to a stacked shorted microstrip antenna for use with wireless communication which requires a physically small antenna with a sufficiently large operational bandwidth and gain.

BACKGROUND OF THE INVENTION

There is an increasing demand for the use of microstrip antennas in wireless communication due to their inherently low back radiation, ease of conformity and high gain as compared to wire antennas. The microstrip antenna design allows for a small amount of radiation produced in one direction, the back of the antenna. The low back radiation generated from a microstrip antenna is important in shielding the human user of the transmitting instrument from the possibly hazardous electromagnetic fields caused during transmissions. A desired application of microstrip antennas is for use in a cellular phone system.

FIG. 1 shows a conventional microstrip antenna for receiving communication signals. The antenna 100 includes a dielectric substrate 101 mounted on a large metallic ground plate 103 with a resonant metallic patch 105 (radiating element) affixed to the opposite side of the substrate 101. The dimensions of the resonant patch is selected as a function of the wavelength of the signals the antenna is to receive and transmit. The length of one side of a square radiating element must be $\lambda/2$, where $\lambda$ is the wavelength of the transmission signals. Thus, if a wavelength of a cellular signal which is to be received by a microstrip antenna is approximately 36 cm, then the dimension of one side of the microstrip antenna must be 18 cm. The antenna's required dimension is larger than the conventional cellular phone's width and therefore unusable for a cellular phone application.

The dimensions of the conventional microstrip antenna can be reduced by increasing the dielectric constant of the microstrip substrate. However, a correspondingly thicker dielectric material is very expensive and is lossy for signal transmissions. Additionally, wireless communication requires a bandwidth of more than 3% which is normally the upper limit of the conventional microstrip antenna's bandwidth. By increasing the dielectric constant of the substrate to reduce the size of the antenna, the bandwidth of the antenna will also be reduced significantly. Thus, microstrip antennas with high dielectric constants cannot meet the common bandwidth specifications of wireless systems.

The low electromagnetic (EM) radiation of a conventional microstrip antenna is useful only in protecting one portion of the cellular phone user, the user's head, which is in the direction of the ground plate. There is no direct path of grounding for the input signal existing on the radiating plate. As a result, strong induced currents exist on the radiating plate. These currents can leak to the user's hand and body which come in contact with the cellular phone.

It would be advantageous to have a microstrip antenna which would limit radiation and surface currents, to be small enough to be practical in a cellular phone or other communication instrument, to have sufficient bandwidth to allow proper operation in wireless communication and to have an improved gain necessary for communication.

SUMMARY

The present invention is a stacked short-circuited microstrip antenna comprising at least two antenna layers which include a dielectric layer with a radiating plate attached to the top of each dielectric layer and a ground plate attached to the opposite side of the antenna layer on the bottom end of the antenna. The layers are each short-circuited on one side of the dielectric layer and the shorted sides are positioned 90 degrees apart from each other. The stacking of the shorted microstrips allows for a smaller antenna with a large resonant bandwidth. The configuration of short-circuited sides promotes circular polarization which allows for better reception and transmission of signals and for improved blockage of electromagnetic radiation.

The stacked shorted microstrip antenna can be used in a cellular phone or other communications instrument.

BRIEF DESCRIPTION OF THE DRAWING

Further objects, features and advantages of the invention will become apparent from the following detailed description taken in conjunction with the accompanying figures showing a preferred embodiment of the invention, in which.

DESCRIPTION OF A PREFERRED EMBODIMENT

The inventive microstrip antenna includes stacked layers of short-circuited (or shorted) dielectric elements with attached radiating elements and a ground plate assembled in a manner that places the short-circuited side of each dielectric layer 90 degrees apart from adjacent antenna layers thus causing the short-circuited sides of adjacent layers to form a right angle. This configuration achieves circular polarization for better signal reception and transmission and also creates an acceptable transmission bandwidth while maintaining a small size for the overall antenna.

Figure 1:
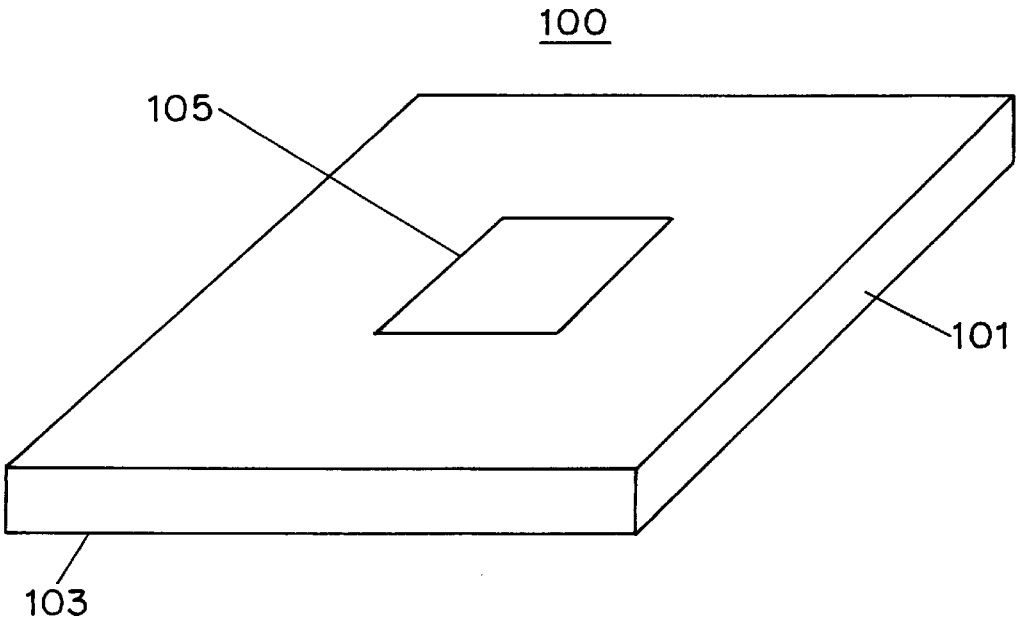
FIG. 1 PRIOR ART
FIG. 1 is a diagram of a microstrip antenna in the prior art.
Figure 2:
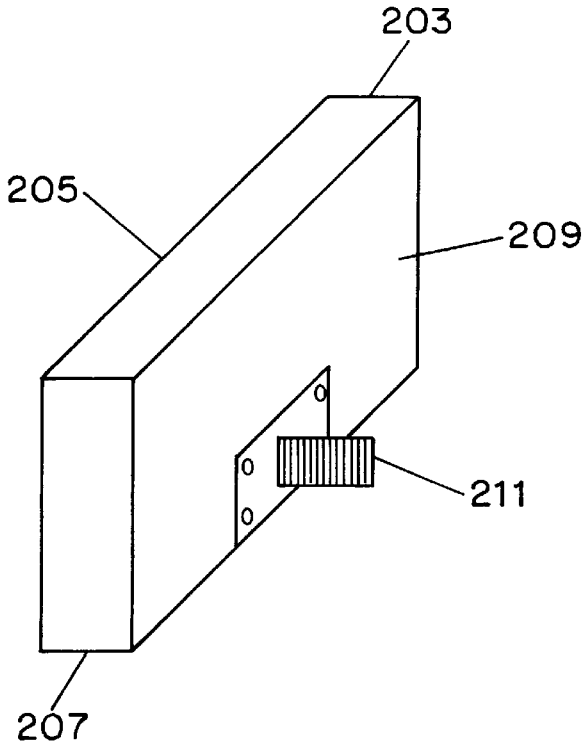
FIG. 2 is a diagram of one layer of a stacked microstrip antenna of the present invention.

FIG. 2 shows one layer 201 of the stacked antenna of the present invention. The dielectric substrate 203 has a metallic layer (radiating layer) 205 on the top of the dielectric and a ground plate 209 on the opposite side. The metallic layer and the ground plate are preferably equal in size to the dielectric layer. A third metalization 207 that shorts the top metallic layer to the ground plate at one side of the dielectric element is added to the antenna to facilitate a reduction in the physical dimensions of the antenna for a given reception and transmission frequency of operation. The short-circuit applied to one side of the dielectric allows the dielectric of the radiating plate to have a dimension which is approximately λ/4, where λ is the wavelength of the received and transmitted signals. When using a dielectric with a mid-ranged dialectic constant (4–10), the dimension of dielectric can be less than 5 cm (λ/4 further adjusted for the dielectric constant) and the antenna can be used in cellular phone applications. The dielectric substrate 203 can be made from available soft substrates such as R 6006 or 6010 from Rogers Corporation or hard substrates such as Alumina from Transtech Corporation. The metallic material, for both the radiating layer and the ground plate, are preferably a conductive metal such as copper, gold, aluminum or silver, although other metals can be used. The dielectric and metallic layers have preferably the same transverse dimensions to simplify the fabrication of the antenna. The antenna signal can be typically be fed through a coaxial connector 211. However, other types of feeds such as a microstrip feed can be used.

Microstrip antennas provide back shielding in one direction from the presence of the ground plate. In addition to the back shielding for head protection (when the user talks into the phone), the presence of the short-circuit is also useful in reducing radiation into the hand and the body. The short has two effects: one is to reduce the EM fields radiated to the body and the second is to reduce the radio-frequency (RF) currents on the phone surface. The second effect is due to the fact that there is a return path of the input current. The presence of a return path can reduce the RF current in the phone and therefore reduce RF leakage to the human user's hand and body by a factor of 10 or more.

The bandwidth of the microstrip antenna can be controlled by varying the thickness of the dielectric. The thicker the dielectric substrate, the larger the bandwidth. However, a thick dielectric can be expensive and lossy for signal transmission and reception. Alternatively, a larger bandwidth can be also obtained by stacking two or more microstrip antenna layers, each layer as described in FIG. 2, on top of one another.

Figure 3:
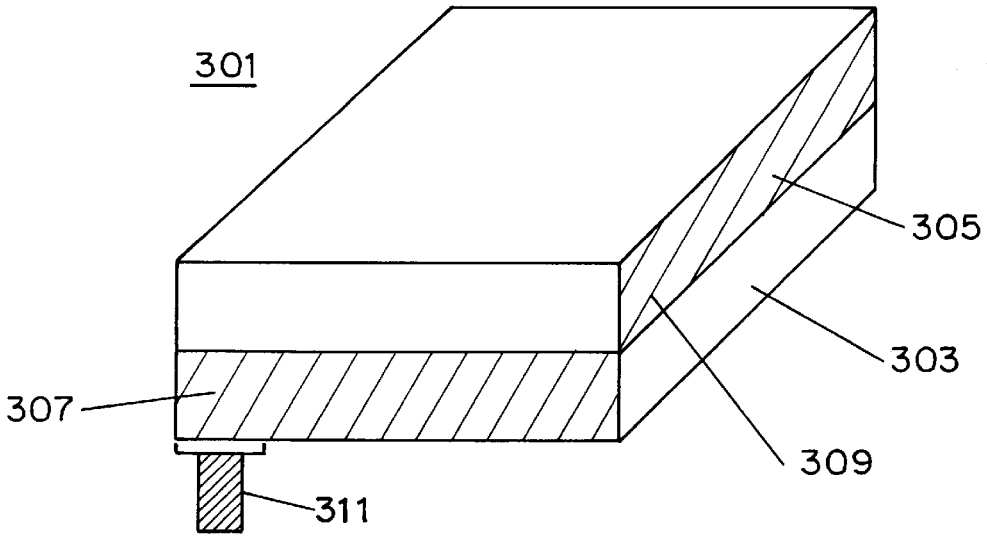
FIG. 3 is a diagram of a stacked microstrip antenna of the present invention.

Referring to FIG. 3, stacked antenna 301 includes a first microstrip antenna layer 303 with one side 307 short-circuited and a second microstrip antenna layer 305 with another short-circuited side 309 located on top of the first microstrip antenna, where the second short-circuited side 309 is orientated 90 degrees apart from the first shorted side 307. Thus, the short-circuited side 309 is positioned at a right angle to short-circuited side 307. Coaxial feed 311 is also shown. This configuration allows for an increased bandwidth for the received and transmitted signals and creates circular polarization which is useful in increasing the gain in harsh weather conditions and helps limit the electromagnetic radiation which may effect the user.

The stacked microstrip antenna of the present invention can be used with cellular or satellite transmission devices such as cellular phones or the GPS (Global Positioning System) satellite system. The antenna can be used for one-way, two-way or multi-party communication, can be used with a locating device that utilizes the cellular or satellite signals or can be used by any device which requires an antenna for receiving or transmitting signals. The unique configuration of the short-circuited antenna layers in the present invention causes circular polarization to take place which enhances the overall quality of the signal being received or transmitted. When a transmission is broadcast in stormy weather, fog or high winds, the turbulence in the signal medium can cause attenuation of the signal traveling in an affected direction. The configuration of the present invention allows for reception in at least two directions and thus the attenuated portion of the signal is compensated for. In order to achieve circular polarization, two antenna layers must have their short-circuited sides located 90 degrees apart from one another causing the short-circuited sides to be at right angles. The antenna layers should preferably be square and have the same or similar dimensions to radiate equally in two perpendicular directions as required for circular polarization. If additional layers are placed on the stacked antenna to further increase the bandwidth, each stacked layer should have a short-circuited side located 90 degrees apart from the short-circuited side of the adjacent antenna layer in order to balance the overall antenna. The balanced antenna utilizes the reception and transmission of signals 90 degrees apart in both space and time (which refers to the phase of the signal).

Figure 4:
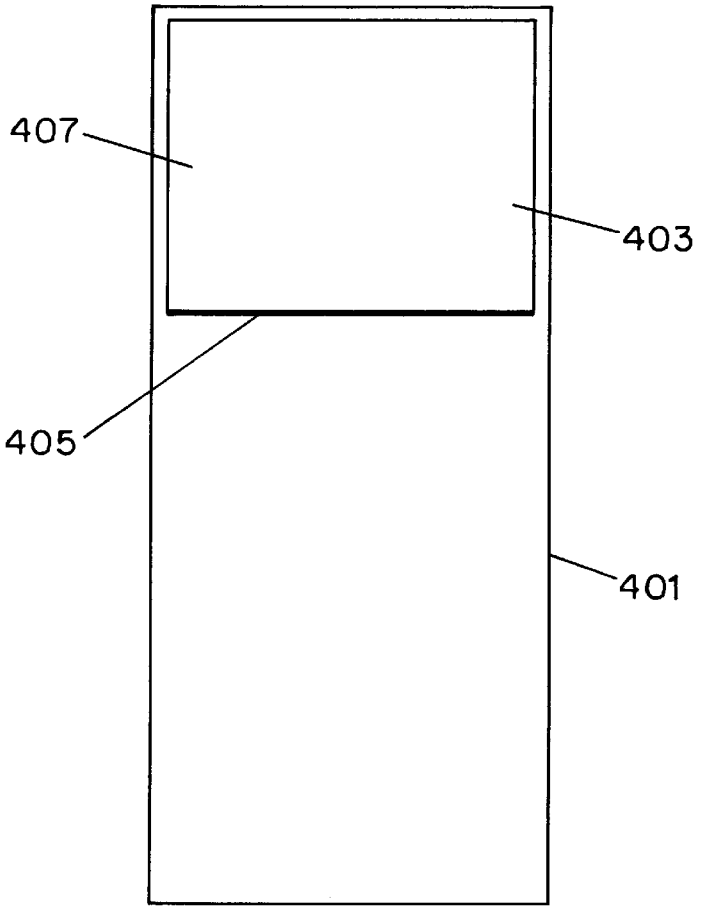
FIG. 4 is a diagram of a cellular phone with an attached stacked microstrip antenna.

FIG. 4 shows the back view of a cellular telephone 401 with a stacked antenna 403 of the present invention which is mounted on the back. The mounting can be performed with any conventional means such as glue, screws or soldering. The shorted side 405 of the top antenna layer is placed facing the hand position of the user in order to dampen the electromagnetic rays. The radiating plate 407 faces away from the back of cellular phone 401 and towards the front so that the ground plate faces the head of the user of the cellular phone. The preferred shape of antenna 403 is square for ease of manufacturing and mounting to the cellular phone 401 as well as gaining the benefit of circular polarization.

A test of the stacked microstrip antenna of the invention shows the benefit of using the stacked microstrip antenna with layers containing short-circuited sides configured in accordance with the invention. A stacked microstrip antenna with layer dimensions of approximately 1.1"×1.1"×0.02" was manufactured with dielectric substrates (with a $E_r$=10.2) of equal size. The resonance frequency of a radiating plate in a conventional microstrip antenna with these dimensions is 1.9 GHz. When a short-circuit is added to one side of the antenna, the resonant frequency decreases to 822 MHz. The second layer of the stacked antenna increased the bandwidth of the antenna.

Figure 5:
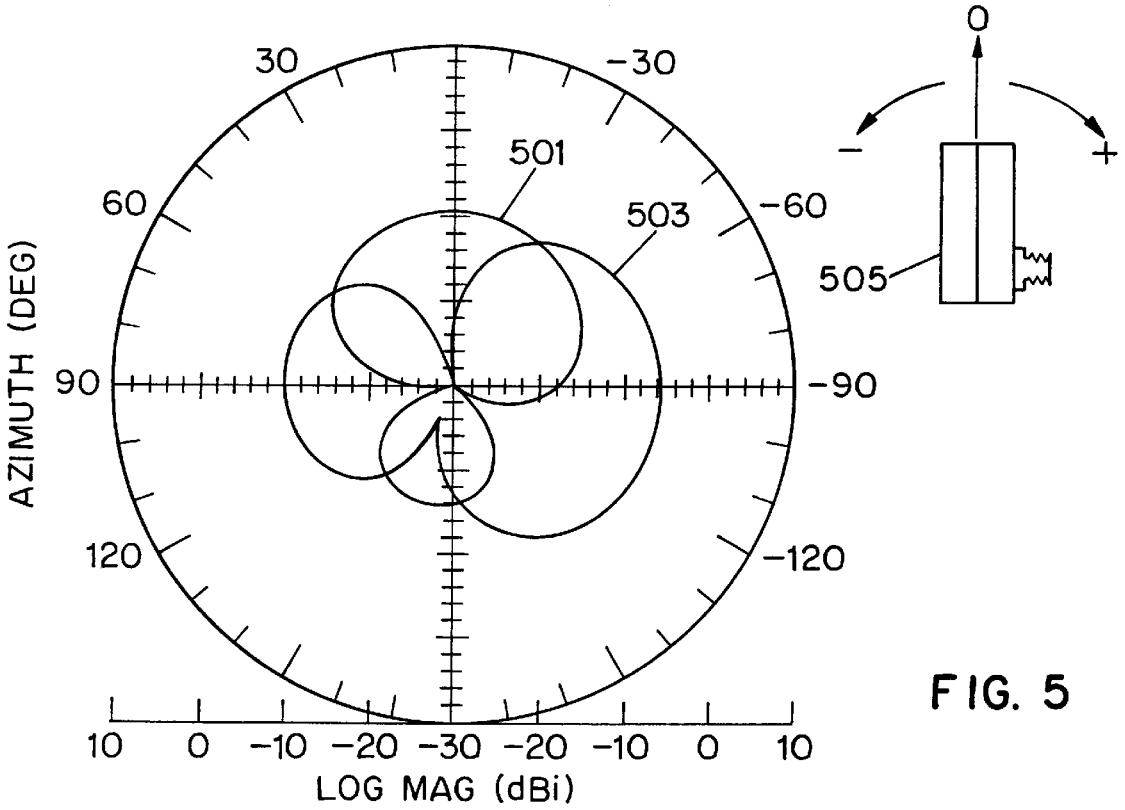
FIG. 5 is a far-field E-plane pattern for a single layer of a stacked microstrip antenna.

The far field pattern for the stacked microstrip antenna is shown in FIG. 5. The vertical orientation of the stacked antenna relative to the sensor which produced the data is shown by antenna 505. The radiation pattern of the E-plane is shown on a compass type grid with an axis of the log of the magnitude of the radiated signals 501 and 503 from the antenna layer verses an axis of the direction of the radiated signal. The radiation pattern shows that the radiation is reduced in multiple directions from the side of the antenna due to the effects of the ground plate, short-circuit means and circular polarization.

Figure 6:
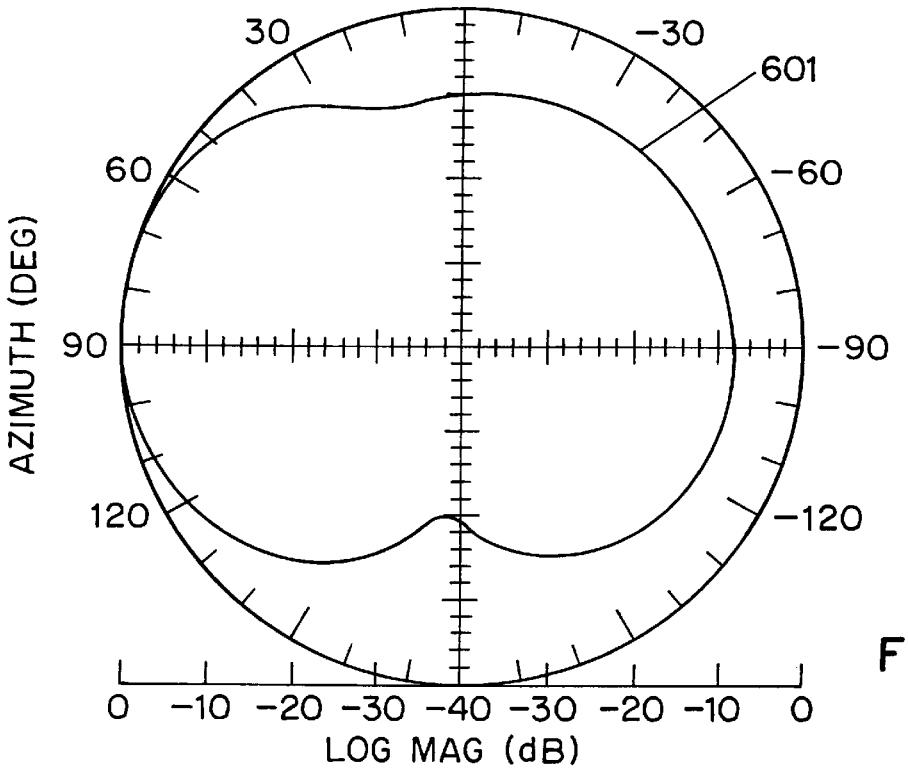
FIG. 6 is a near-field E-plane pattern for a stacked microstrip antenna.

The near field reading of the same antenna using the same sensor orientation is shown in FIG. 6. The near field pattern has the same scale as FIG. 5, and shows a very low level of radiation 601 at the back and two sides of the antenna. This is caused by the ground plate, short-circuited means and circular polarization of the antenna.

Figure 7:
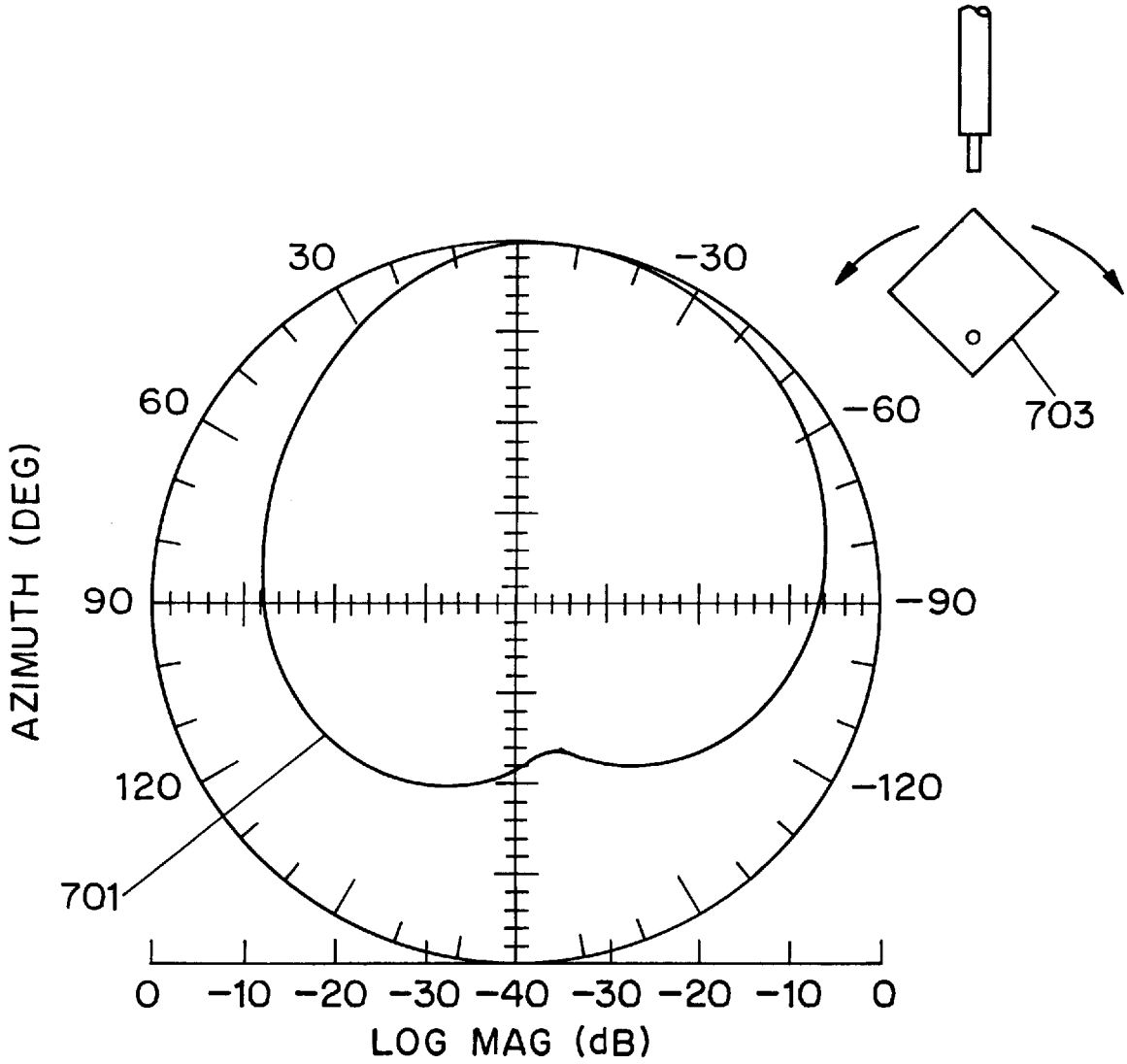
FIG. 7 is a near-field H-plane pattern for a stacked microstrip antenna.

FIG. 7 shows a new field pattern for a horizontal sensor orientation of the antenna. The orientation is shown by antenna 703 with the sensor located directly above it. Radiation 701, which is shown on the same scale as FIGS. 5 and 6, shows that transmission of a signal from the stacked microstrip antenna has a good attenuation in the vertical direction, which is not harmful to the human user. The signal also shows sufficient magnitude to operate a cellular phone.

Figure 8:
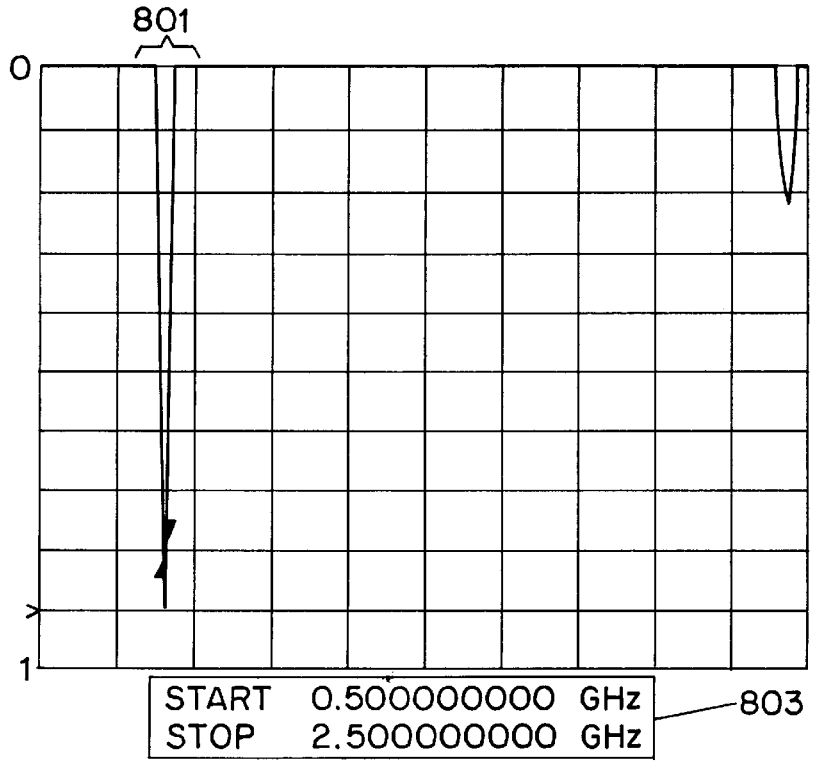
FIG. 8 is a VSWR graph of the reception of a single layer shorted antenna.
Figure 9:
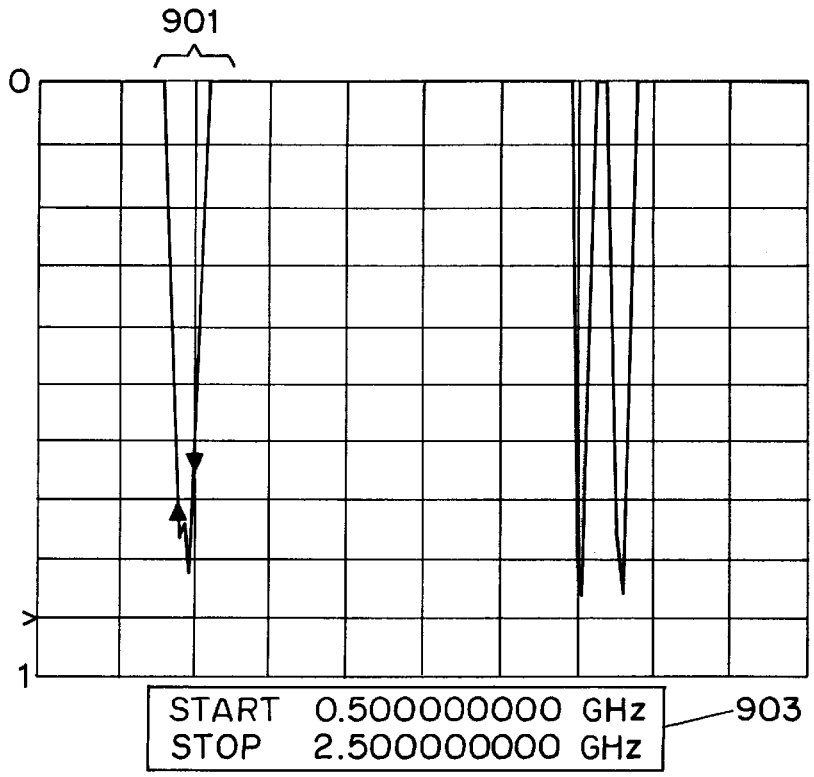
FIG. 9 is a VSWR graph of the reception of stacked shorted microstrip antenna in accordance with the invention.

The effect of stacking the antenna layers on the bandwidth of the overall antenna is shown in FIGS. 8 and 9. FIG. 8 shows the bandwidth of a single layer of antenna with dimensions of approximately 1.1"×1.1"×0.02". The graph shows that the antenna is well matched at a bandwidth of 8 MHz (1% of the frequency in the wireless range) shown as spacing 801. Box 803 shows the beginning and ending frequencies on the X axis of the graph. When a second microstrip antenna layer is stacked on top of the first antenna layer and the shorted sides are positioned 90 degrees apart, the bandwidth increases to 40 MHZ (5% of the frequency in the wireless range) as shown in FIG. 9. Spacing 901 shows the 40 MHz bandwidth of which the antenna can receive and transmit signals. Box 903 shows the beginning and ending frequencies on the X axis of the graph. Thus, a stretched microstrip antenna of the invention satisfies the bandwidth required of a cellular phone system.

Figure 10:
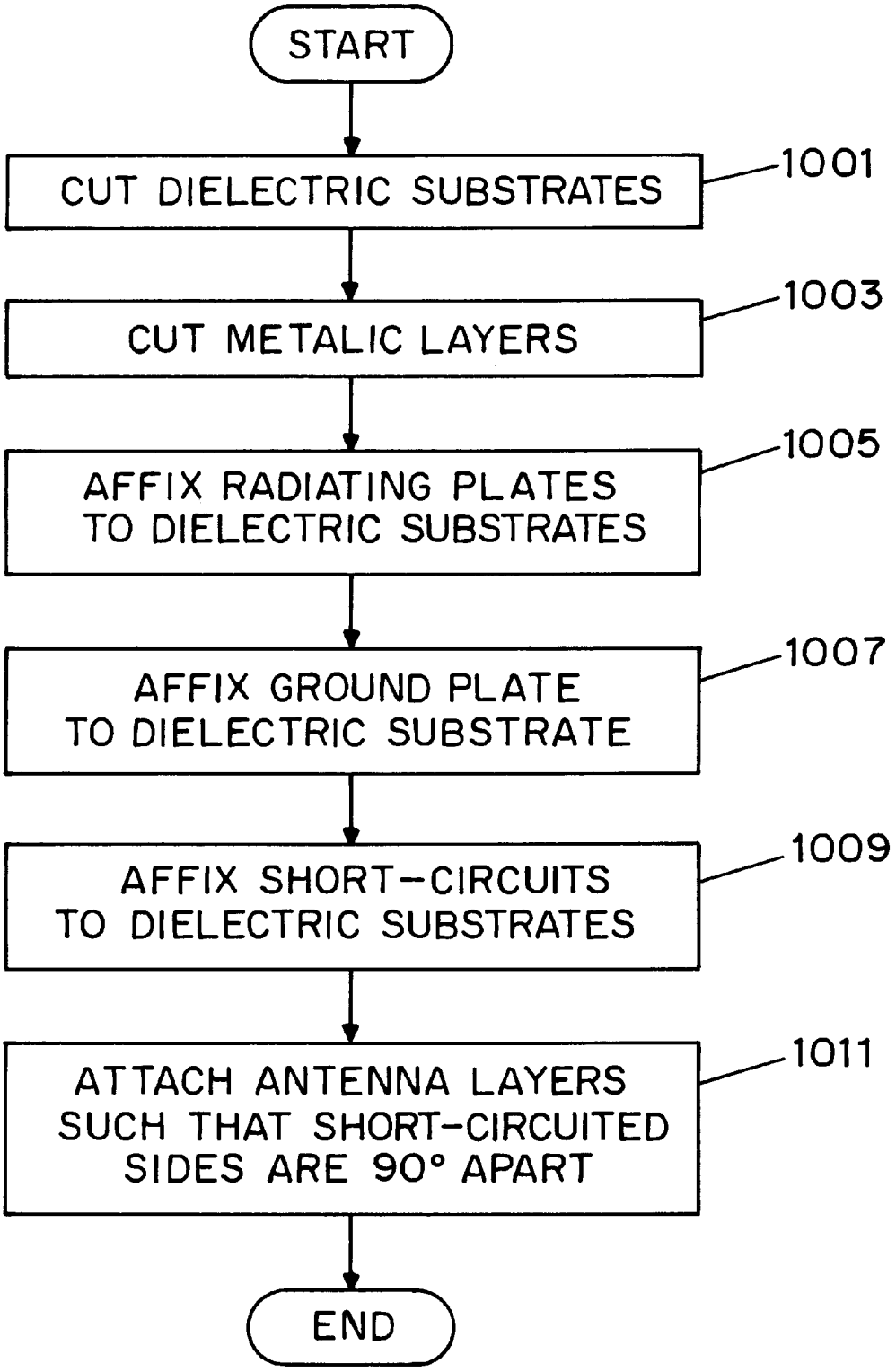
FIG. 10 is a list of steps to manufacture the stacked shorted microstrip antenna.

FIG. 10 shows the steps of a method for manufacturing the stacked microstrip antenna. First, the dielectric material is selected and cut in step 1001 to specified dimensions which will be able to fit in a cellular phone or other selected communications/location device. An example of the material is a soft substrate R 6006 from Rogers Co. The shape of the dielectric piece will preferable be square for ease of manufacturing. The square shape also promotes circular polarization. Next, a metalization layer material for the radiating layers, ground layer and short-circuit layers is selected and cut in step 1003 and its dimensions preferably will be substantially the same as the dielectric layer. The same metalization material can be used for the radiating layer, the ground plate and the short-circuit material. The metallic layer can be a film applied to the dielectric layer rather than being cut. In step 1005, the top metalization layer (radiating layer) is affixed to the top of each dielectric layer. This can be performed by applying a metallic foil to the dielectric layer and placing an adhesive material between the foil and the dielectric layer. By attaching an entire radiating layer to the dielectric layer, manufacturing costs are reduced over other conventional microstrip antenna, which etch a radiating element into the dielectric layer. In step 1007, the ground plate is affixed to the other side of the bottom dielectric layer. This is accomplished by using an adhesive material between the ground plate and the dielectric layer. Next, a short-circuit material is affixed to one side of each dielectric layer in step 1009 placing the short-circuit material in contact with both the radiating layer and the ground plate (or if the dielectric layer is not the bottom layer, then in contact with the radiating layer of the dielectric element directly beneath the dielectric layer instead of the ground plate). The short-circuit material is affixed to the dielectric layer by an adhesive material or in another conventional manner. The short-circuiting material preferably covers the entire side of the dielectric layer. The order of cutting and attaching the individual layers can be altered to the manufacturers needs.

At least two microstrip antenna layer are assembled in the same manner, with the exception of the ground plate being required only for the bottom layer. The two antenna layers are then joined together in step 1011, one on top of the other, with the layer with the ground plate being placed on the bottom of the configuration. The short-circuited sides of each layer are positioned 90 degrees apart as shown in FIG. 3. The short-circuit sides will therefore not be overlapping. The radiating layer of the bottom layer (first layer) will act as the ground plate for the top layer (second layer). Other dielectric layers with radiating plates can be added to the microstrip antenna. In order to maintain the benefit of circular polarization, the antenna layers should be stacked in pairs of two and the shorted side of each antenna layer spaced 90 degrees apart from the adjacent layers, so that the radiation effect is offset 90 degrees for each dielectric layer.

The microstrip antenna made in accordance with the invention can then be placed in a cellular phone so that it may received a broad band of frequencies with increased quality of reception/transmission while being relatively inexpensive to manufacture. Attaching the microstrip antenna to the phone can be accomplished with an adhesive material, screws, a form fitting cut-out or other conventional means.

The foregoing merely illustrates the principles of the invention. It will thus be appreciated that those skilled in the art will be able to devise numerous systems, apparatus and methods which, although not explicitly shown or described herein, embody the principles of the invention and are thus within the spirit and scope of the invention as defined by its claims.

I claim:

1. A stacked microstrip antenna comprising:

a ground plate;

a first dielectric layer disposed on said ground plate;

a first radiating layer disposed on said dielectric layer;

a second dielectric layer disposed on said first radiating layer;

a second radiating layer disposed on said second dielectric layer;

a first short-circuiting means disposed along a first selected side of said first dielectric layer and being connected to said first radiating layer and said ground plate; and a second short-circuiting means disposed along a second selected side of said second dielectric layer and being connected to said second radiating layer and said first radiating layer;

wherein said first and second selected sides are oriented substantially 90 degrees apart and substantially form a right angle.

2. The antenna of claim 1, further comprising at least one additional antenna layer comprising an additional dielectric layer, an additional radiating layer disposed on said additional dielectric layer, and an additional short-circuiting means disposed on a selected side of said additional dielectric layer, wherein each of said additional antenna layers is stacked upon said microstrip antenna and each said additional short-circuiting means is substantially oriented 90 degrees apart from said short-circuiting means of a dielectric layer located directly below it.

3. The antenna of claim 1, wherein said first and second dielectric layers and said first and second radiating layers are of substantially equal size.

4. The antenna of claim 3, wherein said ground plate is of substantially equal size as said first dielectric layer.

5. The antenna of claim 1, wherein each said dielectric layer has substantially equal dimensions on each side.

6. The antenna of claim 1, wherein said first short-circuiting means covers substantially all of said first selected side of said first dielectric layer.

7. The antenna of claim 6, wherein said second short-circuiting means covers substantially all of said second selected side of said second dielectric layer.

8. The antenna of claim 1, wherein said first and second short-circuiting means in said antenna causes circular polarization.

9. The antenna of claim 1, further including a means for coupling said antenna to a cellular phone.

10. The stacked microstrip antenna of claim 2, wherein said antenna has two additional layers.

* * * * *

UNITED STATES PATENT AND TRADEMARK OFFICE

CERTIFICATE OF CORRECTION

PATENT NO. : 5,945,950

DATED : August 31, 1999

INVENTOR(S) : Elbadawy Elsharawy

It is certified that error appears in the above-identified patent and that said Letters Patent is hereby corrected as shown below:

Cover page, at [19], "Elbadawy" should read --Elsharawy--; at [75] "Elsharawy A. Elbadawy" should read --Elbadawy A. Elsharawy--.

Signed and Sealed this

Tenth Day of April, 2001

*Attest:*

NICHOLAS P. GODICI

*Attesting Officer*

*Acting Director of the United States Patent and Trademark Office*